US009624654B2

(12) United States Patent
Tseng et al.

(10) Patent No.: US 9,624,654 B2
(45) Date of Patent: Apr. 18, 2017

(54) ELECTRONIC FAUCET CONTROLLED BY HANDLE

(71) Applicant: Globe Union Industrial Corp., Taichung (TW)

(72) Inventors: Kuoming Tseng, Taichung (TW); Chaota Yang, Taichung (TW); Hsiantsung Chen, Taichung (TW)

(73) Assignee: GLOBE UNION INDUSTRIAL CORP., Taichung (TW)

( * ) Notice: Subject to any disclaimer, the term of this patent is extended or adjusted under 35 U.S.C. 154(b) by 114 days.

(21) Appl. No.: 14/662,048

(22) Filed: Mar. 18, 2015

(65) Prior Publication Data

US 2015/0292187 A1 Oct. 15, 2015

(30) Foreign Application Priority Data

Apr. 9, 2014 (CN) ..... 2014 1 0140508

(51) Int. Cl.
*E03C 1/05* (2006.01)
*E03C 1/04* (2006.01)

(52) U.S. Cl.
CPC ..... *E03C 1/055* (2013.01); *E03C 1/0412* (2013.01); *E03C 2001/0415* (2013.01)

(58) Field of Classification Search
CPC ..... E03C 1/055; E03C 1/0412
See application file for complete search history.

(56) References Cited

U.S. PATENT DOCUMENTS

2011/0139256 A1* 6/2011 Maercovich ..... E03C 1/055 137/1
2014/0026997 A1* 1/2014 Mielke ..... E03C 1/04 137/801
2014/0352799 A1* 12/2014 Rosko ..... C02F 1/78 137/237
2015/0121616 A1* 5/2015 Peteri ..... E03C 1/0412 4/677

* cited by examiner

*Primary Examiner* — Janie Loeppke

(57) ABSTRACT

An electronic faucet controlled by handle contains: a body, a control assembly, a water pipe set, a solenoid valve, and a magnetic sensing device. The body includes a handle seat and an outlet. The control assembly includes a valve member and a rotary lever rotated toward an opened position and a closed position. The water pipe set includes a cold-water inlet pipe, a hot-water inlet pipe, and a mixing outlet pipe. The solenoid valve is secured on the mixing outlet pipe and is opened to flow the mixing water, and the solenoid valve is closed to stop the mixing water. The magnetic sensing device includes a magnetic element mounted on the rotary lever. In addition, a magnetic sensor is fixed between the handle seat and the valve member adjacent to the magnet element.

17 Claims, 16 Drawing Sheets

ELECTRONIC FAUCET CONTROLLED BY HANDLE

FIELD OF THE INVENTION

The present invention relates to a faucet, and more particularly to an electronic faucet controlled by handle which control a ratio of cold water and hot water.

BACKGROUND OF THE INVENTION

A conventional faucet controlled by handle controls water supply after rotating a rotary lever to mix a ratio of cold water and hot water as disclosed in TW Utility Model No. M318692.

A conventional electronic faucet controls a ratio of cold water and hot water after rotating a rotary lever by ways of a touch switch, and then a signal is transmitted to a control panel and is processed to open or close a solenoid valve, thus supplying water or stopping supplying the water.

However, the touch switch is in a large size to increase production cost and installation space. Furthermore, contact point of the touch switch is broken easily, such as getting rusty.

To overcome such problem, a non-touch switch, such as a reed switch or a hall sensor for matching with a magnetic element is employed to replace the touch switch.

For example, a hall effect sensor disclosed in US Publication No. 20060289343A1 is fixed on a faucet, but it is applicable for filters, such as a sediment filters, carbon filters, or RO membrane of RO filtering system. In other words, the hall effect sensor is merely used in non-electronic faucet.

The present invention has arisen to mitigate and/or obviate the afore-described disadvantages.

SUMMARY OF THE INVENTION

The primary objective of the present invention is to provide an electronic faucet controlled by handle which is compact and is fixed easily to reduce production cost.

To obtain the above objective, an electronic faucet controlled by handle provided by the present invention contains: a body, a control assembly, a water pipe set, a solenoid valve, and a magnetic sensing device.

The body is mounted on a washbasin and includes a handle seat and an outlet.

The control assembly is fixed on the handle seat of the body and includes a valve member and a rotary lever rotated to control the valve member. The rotary lever is rotated toward an opened position and a closed position.

The water pipe set includes a cold-water inlet pipe, a hot-water inlet pipe, and a mixing outlet pipe communicating with the valve member of the control assembly to guide cold water and hot water into the valve member and to guide mixing water, in which the cold water and the hot water are mixed, out of the outlet of the body via the valve member.

The solenoid valve is secured on the mixing outlet pipe and opened to flow the mixing water, and the solenoid valve is closed to stop the mixing water.

The magnetic sensing device includes a magnetic element mounted on the rotary lever and includes a magnetic sensor fixed between the handle seat and the valve member adjacent to the magnet element.

When the rotary lever is rotated toward the opened position, the magnetic element moves away from the magnetic sensor, such that the magnetic sensor diminishes or disappears its magnetic force to open the solenoid valve, thus flowing the mixing water.

When the rotary lever is rotated toward the closed position, the magnetic element moves close to the magnetic sensor, hence the magnetic sensor is sensed by the magnetic force to close the solenoid valve, thus stopping the mixing water.

DETAILED DESCRIPTION OF THE PREFERRED EMBODIMENTS

Figure 1:
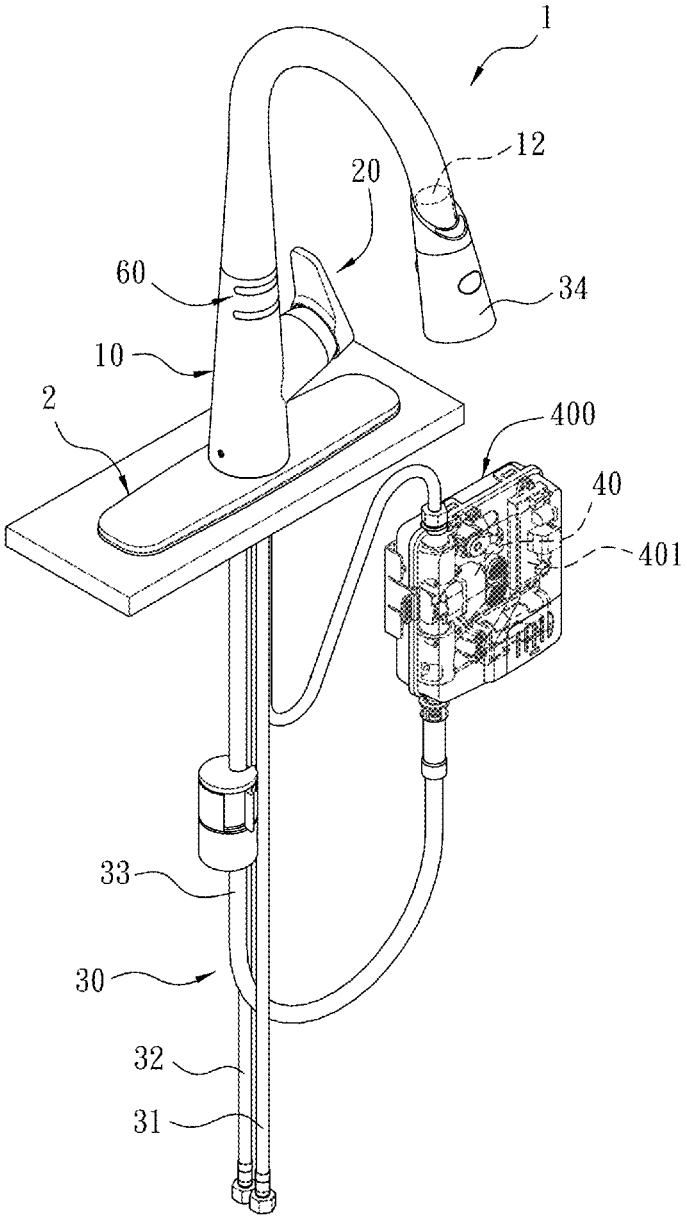
FIG. 1 is a perspective view showing the assembly of an electronic faucet controlled by handle according to a first embodiment of the present invention.
Figure 2:
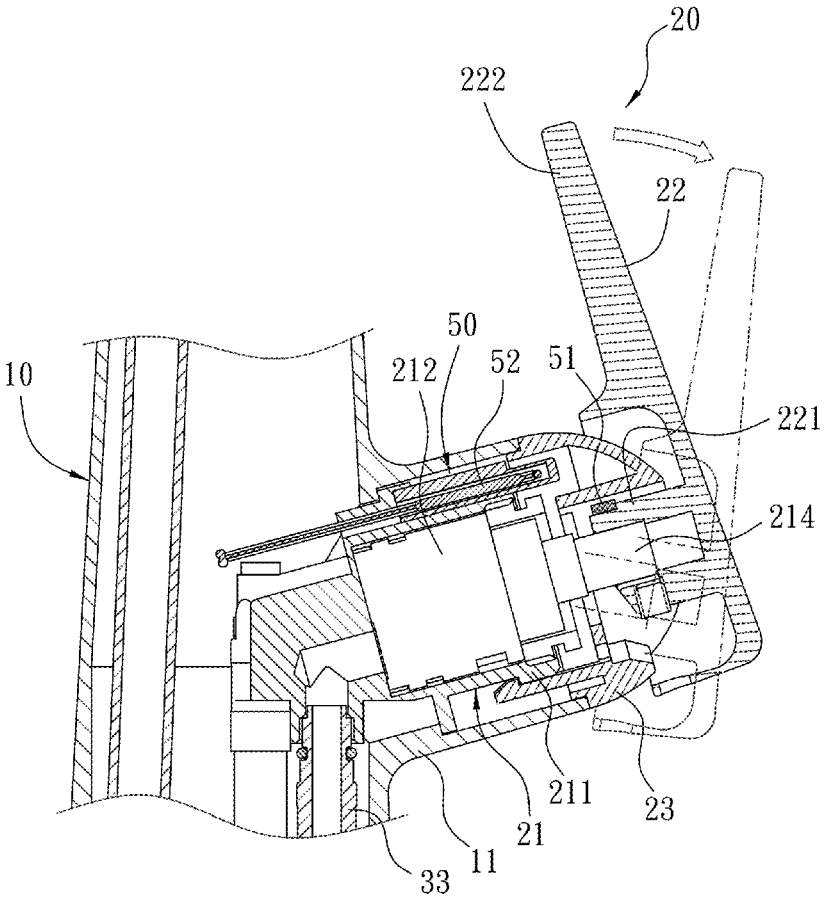
FIG. 2 is a cross sectional view showing the assembly and the operation of a part of the electronic faucet controlled by the handle according to the first embodiment of the present invention.
Figure 3:
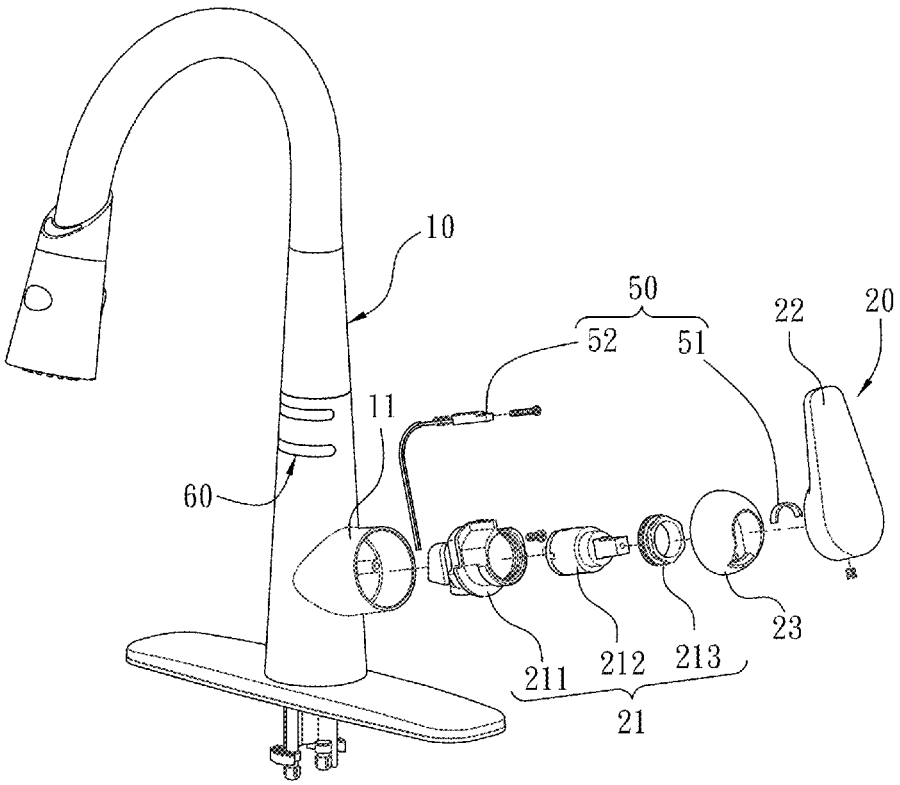
FIG. 3 is a perspective view showing the exploded components of a part of the electronic faucet controlled by the handle according to the first embodiment of the present invention.

With reference to FIGS. 1 to 3, an electronic faucet 1 controlled by handle according to a first embodiment of the present invention comprises: a body 10, a control assembly 20, a water pipe set 30, a solenoid valve 40, and a magnetic sensing device 50.

The body 10 is mounted on a washbasin 2 and includes a handle seat 11 and an outlet 12.

The control assembly 20 is fixed on the handle seat 11 of the body 10 and includes a valve member 21 and a rotary lever 22 rotated to control the valve member 21. The rotary lever 22 is rotated toward an opened position and a closed position. As shown in FIG. 2, the rotary lever 22 is rotated toward the closed position, and it is rotated downwardly to locate at the opened position indicated by an imaginary line.

The water pipe set 30 includes a cold-water inlet pipe 31, a hot-water inlet pipe 32, and a mixing outlet pipe 33 communicating with the valve member 21 of the control assembly 20 to guide cold water and hot water into the valve member 21 and to guide mixing water, in which the cold water and the hot water are mixed, out of the outlet 12 of the body 10 via the valve member 21. In this embodiment, the mixing outlet pipe 33 is in connection with a pull-out spray head 34, wherein when the spray head 34 is not pulled outwardly, it is positioned on the outlet 12 of the body 10.

The solenoid valve 40 is secured on the mixing outlet pipe 33 and is opened to flow the mixing water, and the solenoid valve 40 is closed to stop the mixing water. In this embodiment, the solenoid valve 40 is disposed in an accommodation case 400.

Figure 5:
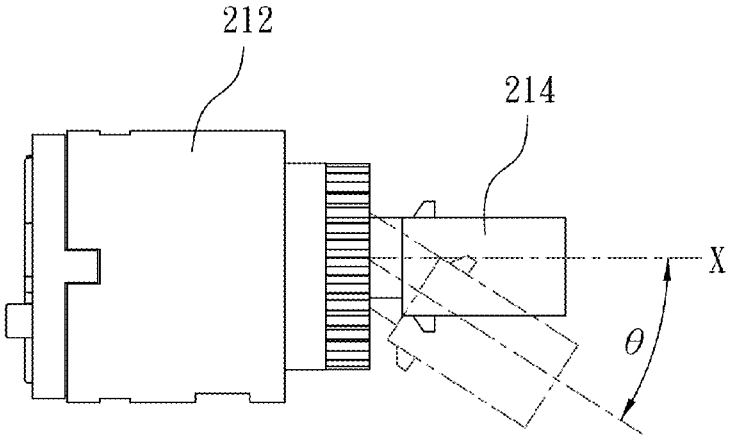
FIG. 5 is a side plan view showing the operation of a part of the electronic faucet controlled by the handle according to the first embodiment of the present invention.

The magnetic sensing device 50, as shown in FIG. 5, includes a magnetic element 51 mounted on the rotary lever 22 and includes a magnetic sensor 52 fixed between the handle seat 11 and the valve member 21 adjacent to the magnet element 51. In this embodiment, the magnetic element 51 is a magnet, and the magnetic sensor 52 is a reed switch.

When the rotary lever 22 is rotated toward the opened position, the magnetic element 51 moves away from the magnetic sensor 52, such that the magnetic sensor 52 diminishes or disappears its magnetic force to open the solenoid valve 40, hence the mixing water flows out of the spray head 34 via the mixing outlet pipe 33. When the rotary lever 22 is rotated toward the closed position, the magnetic element 51 moves close to the magnetic sensor 52, hence the magnetic sensor 52 is sensed by the magnetic force to close the solenoid valve 40, thus stopping the mixing water flowing out of the spray head 34.

Figure 4:
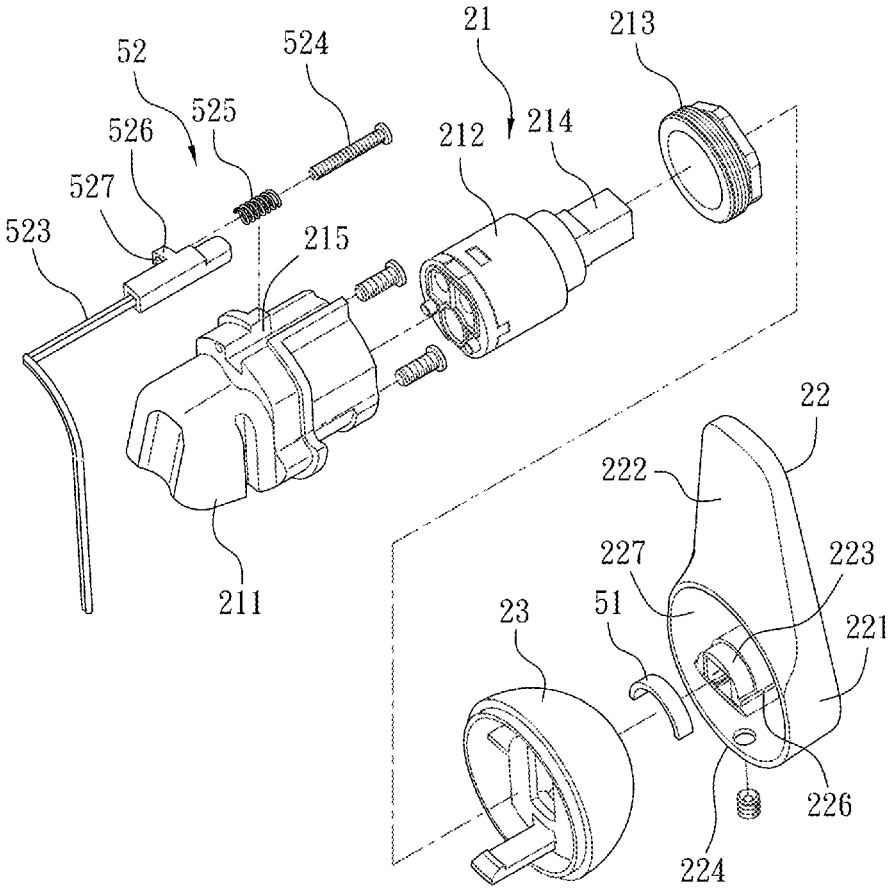
FIG. 4 is another perspective view showing the exploded components of a part of the electronic faucet controlled by the handle according to the first embodiment of the present invention.

Referring further to FIGS. 4 and 5, the valve member 21 has a holder 211 locked in the handle seat 11, a valve core 212 mounted in the holder 211, and a lid 213 screwing with the holder 211 to fix the valve core 212 in the holder 211.

The valve core 212 has a driving shaft 214. The rotary lever 22 has a base 221 and an operating extension 222 extending outwardly from the base 221. The base 221 is fitted with the operating shaft 214 of the valve core 212, such that the rotary lever 22 is rotated to drive the driving shaft 214.

Figure 6:
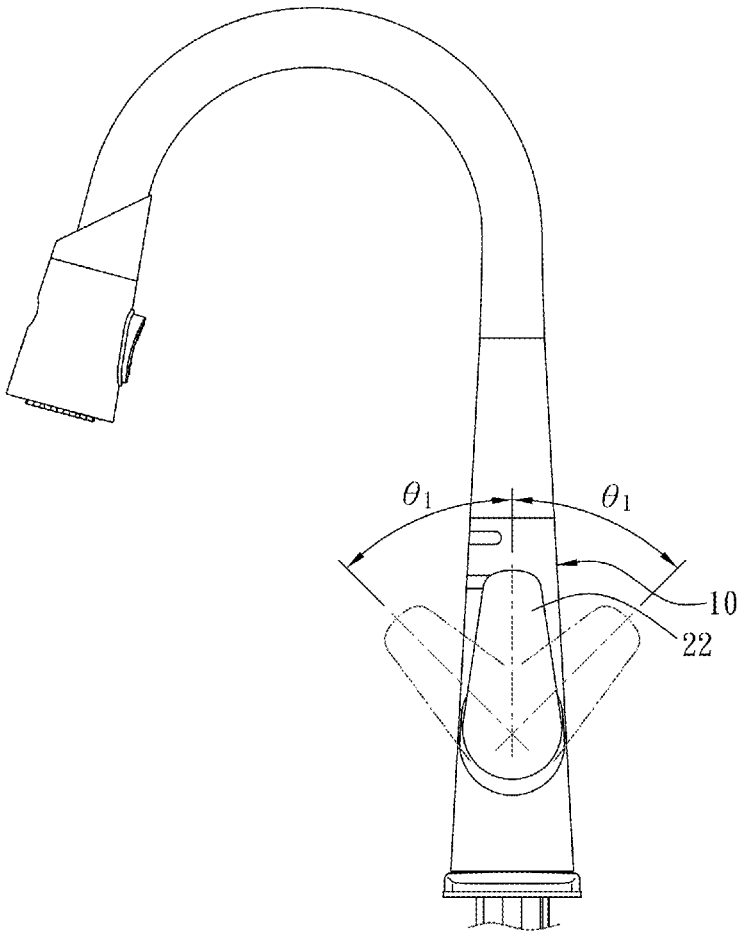
FIG. 6 is another side plan view showing the operation of the electronic faucet controlled by the handle according to the first embodiment of the present invention.

As illustrated in FIGS. 2 and 5, when the rotary lever 22 is located at the closed position, the driving shaft 214 is parallel to an axis X of the valve core 212, and when the rotary lever 22 is rotated toward the opened position, a first angle θ forms between the driving shaft 214 and the axis X. In this embodiment, the first angle θ is within 15 to 45 degrees. With reference to FIG. 6, the rotary lever 22 is positioned at an intermediate position, i.e., a mixing-water supply position, and the rotary lever 22 is rotated a second angle θ1 clockwise or counterclockwise, wherein the second angle θ1 is 45 degrees. When the rotary lever 22 is rotated clockwise, a ratio of the mixing water gradually increases until one of the cold water and the hot water completely flows, and when the rotary lever 22 is rotated counterclockwise, another ratio of the mixing water gradually increases until the other of the cold water and the hot water completely flows.

Figure 7:
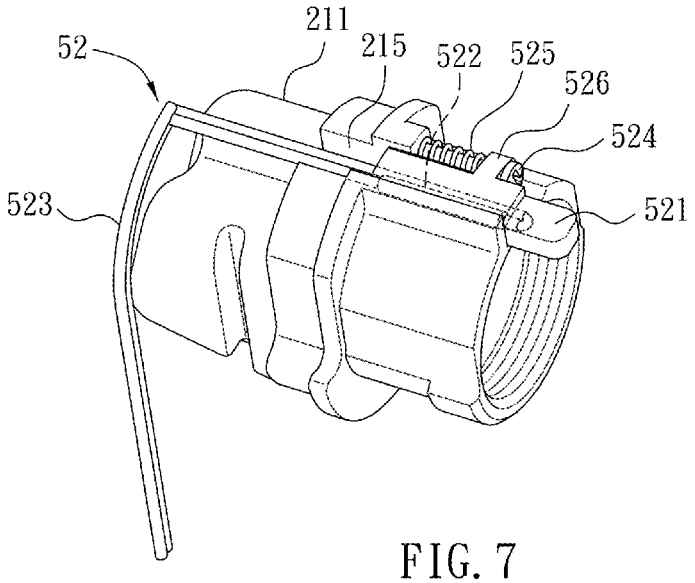
FIG. 7 is a perspective view showing the assembly of a part of the electronic faucet controlled by the handle according to the first embodiment of the present invention.
Figure 8:
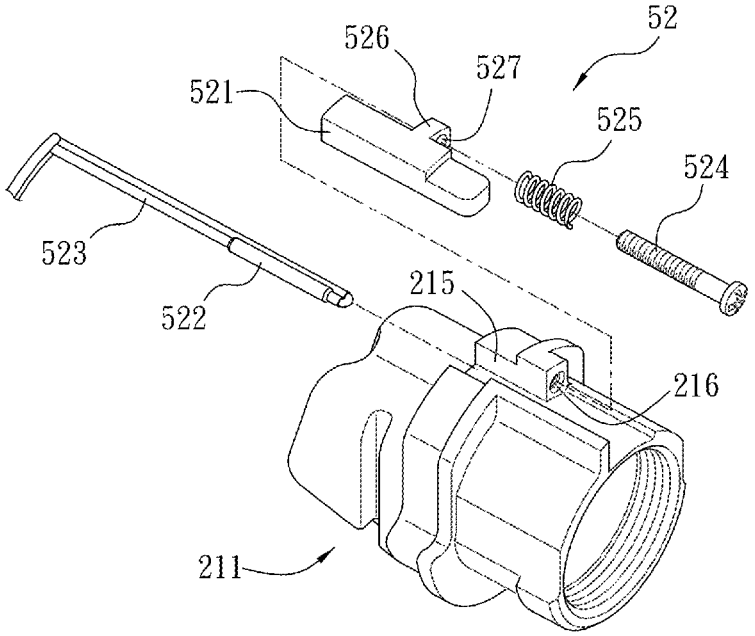
FIG. 8 is still another perspective view showing the exploded components of a part of the electronic faucet controlled by the handle according to the first embodiment of the present invention.

With reference to FIG. 2, the magnetic sensor 52 is coupled with an outer wall of the holder 211. As shown in FIGS. 7 and 8, the holder 211 has a fixing slot 215 defined thereon and has a threaded orifice 216 proximate to the fixing slot 215. The magnetic sensor 52 includes a housing 521, a reed switch 522 fixed in the housing 521, a transmission wire 523 electrically connected with the reed switch 522 to transmit a sensing signal, an adjusting bolt 524, and a spring 525; the housing 521 is retained in the fixing slot 215 of the holder 211, and the housing 521 has a positioning portion 526 extending outwardly therefrom, wherein the positioning portion 526 has a through hole 527 formed thereon, such that the adjusting bolt 524 is inserted through the through hole 527 of the positioning portion 526 to screw with the threaded orifice 216 of the holder 211, and the magnetic sensor 52 is coupled with the holder 211. It is to be noted that the spring 525 is fitted on the adjusting bolt 524 between the positioning portion 526 and the holder 211 to abut against the positioning portion 526, hence when the adjusting bolt 524 is rotated tightly to press the spring 525, it also drives the housing 521 and the reed switch 522 to move away from the magnetic element 51 along the fixing slot 215. When the adjusting bolt 524 is rotated loosely, the housing 521 and the reed switch 522 are pushed by the spring 525 to move close to the magnetic element 51 along the fixing slot 215. In other words, no matter the rotary lever 22 is located at the opened position or the closed position, the adjusting bolt 524 is rotated to adjust a distance between the magnetic sensor 52 and the magnetic element 51, thus randomly adjusting a magnetic force between the magnetic sensor 52 and the magnetic element 51.

Figure 9:
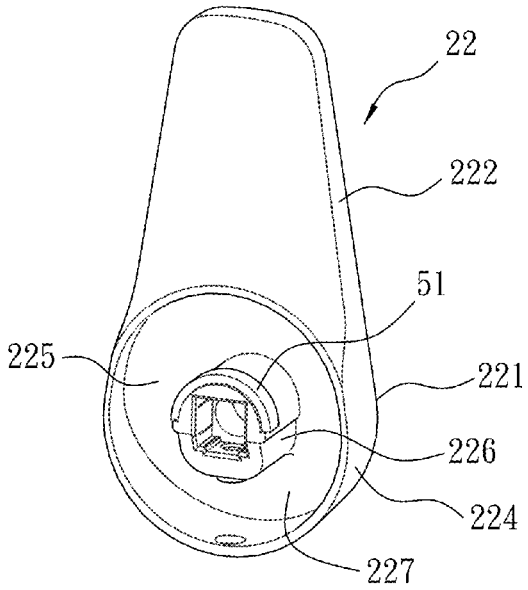
FIG. 9 is another perspective view showing the assembly of a part of the electronic faucet controlled by the handle according to the first embodiment of the present invention.
Figure 11:
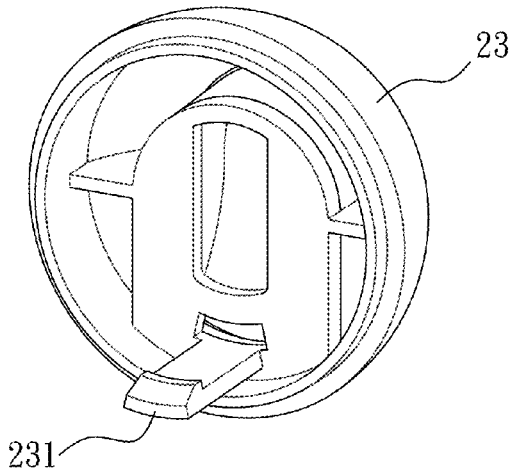
FIG. 11 is still another perspective view showing the assembly of a part of the electronic faucet controlled by the handle according to the first embodiment of the present invention.
Figure 12:
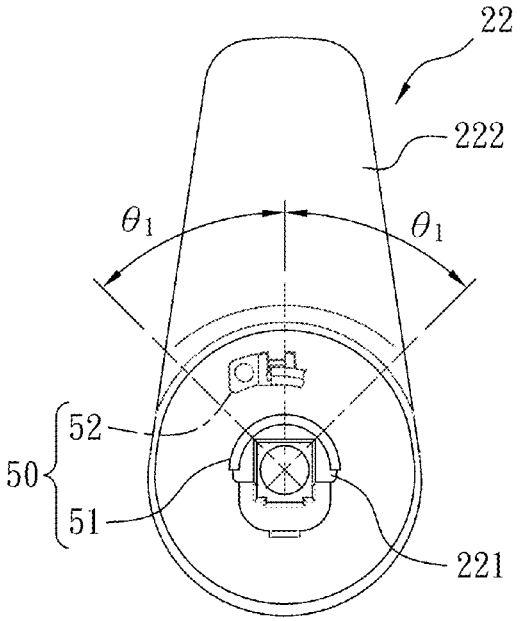
FIG. 12 is another side plan view showing the operation of the electronic faucet controlled by the handle according to the first embodiment of the present invention.

As shown in FIGS. 4 and 9, the magnetic element 51 is coupled with an outer wall of the base 221 of the rotary lever 22. The base 221 of the rotary lever 22 has an arcuate face 223 formed thereon, and the magnetic element 51 is arcuate to connect with the arcuate face 223 by using adhesive agent. As illustrated in FIG. 11, since the magnetic element 51 is arcuate, the rotary lever 22 is rotated toward any one of a cold-water supply position, a hot-water supply position, and the mixing-water supply position.

Figure 10:
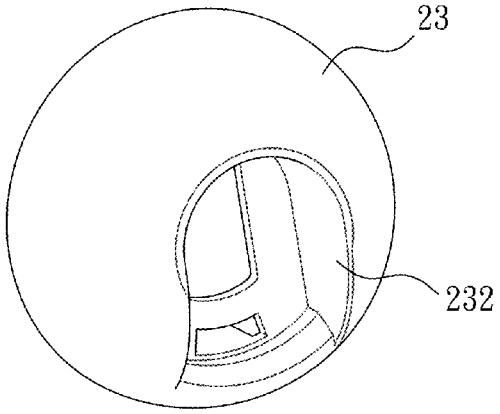
FIG. 10 is also another perspective view showing the assembly of a part of the electronic faucet controlled by the handle according to the first embodiment of the present invention.

With reference to FIGS. 2 to 4, the control assembly 20 further includes a decorative cover 23 having a retaining portion 232 for retaining with the outer wall of the holder 211 of the valve member 21 and for covering the handle seat 11 of the body 10, such that the valve member 21 is covered in the handle seat 11, and the base 221 of the rotary lever 22 is accommodated in the decorative cover 23. As shown in FIGS. 10 and 11, the decorative cover 23 has a chamber 232 so that when the rotary lever 22 is shifted toward the closed position or the opened position, the driving shaft 214 of the valve core 212 and the base 221 of the rotary lever 22 move downwardly or upwardly.

Referring to FIGS. 1 and 3, the electronic faucet 1 further comprises an infrared sensor 60 for sensing a distance to a user, such that the solenoid valve 40 is opened and is closed, and the solenoid valve 40 is controlled by the magnetic sensing device 50 and the infrared sensor 60. The infrared sensor 60 is installed on the body 10.

As illustrated in FIG. 1, the electronic faucet 1 further comprises a controlling panel 401 mounted in the accommodation case 400 to receive the sensing signal from the magnetic sensing device 50 via the transmission wire 523, and then the sensing signal is processed to transmit a control signal to open or close the solenoid valve 40.

As shown in FIGS. 4 and 9, the base 221 of the rotary lever 22 has a circular fence 224 connecting with the operating extension 222, a peripheral fence 225 coupling with the circular fence 224, and a fitting pedestal 226 extending outwardly from the peripheral fence 225 and retained with the driving shaft 214 of the valve core 212. Between the peripheral fence 225 and the fitting pedestal 226 is defined a groove 227 to accommodate a part of the decorative cover 23. The fitting pedestal 226 has an arcuate fringe 223 formed around an outer wall thereof to contact with the magnetic element 51.

Figure 13:
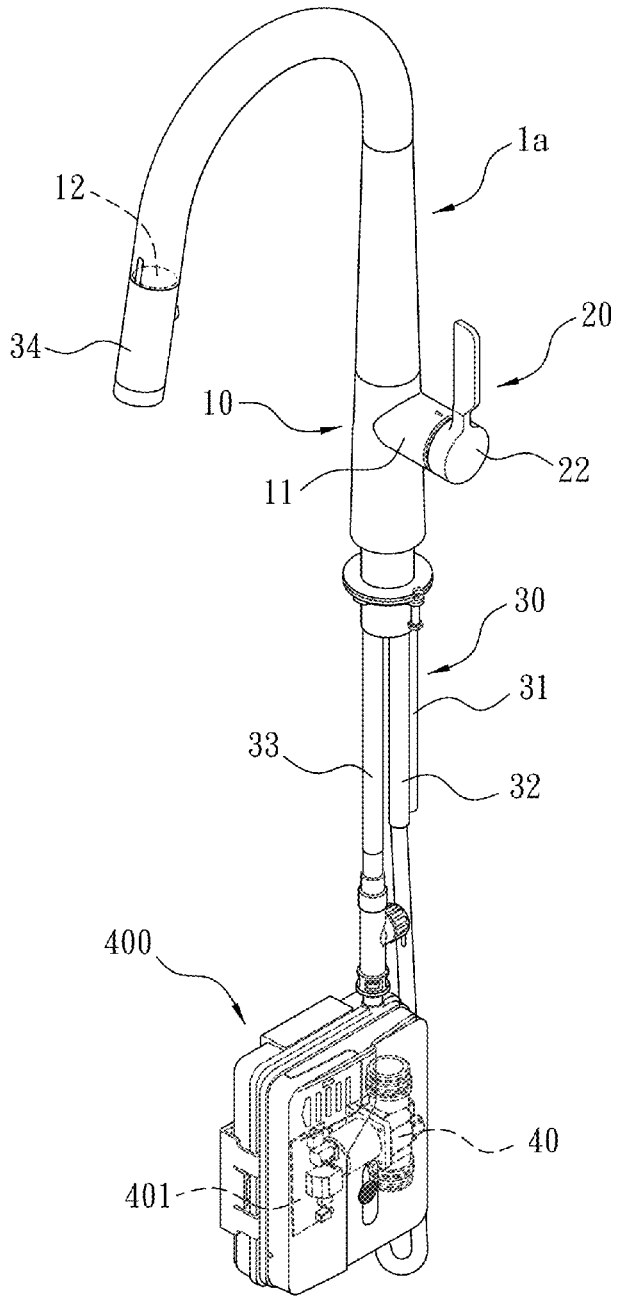
FIG. 13 is a perspective view showing the assembly of an electronic faucet controlled by handle according to a second embodiment of the present invention.

With reference to FIG. 13, a difference of an electronic faucet 1*a* controlled by handle of a second embodiment from that of the first embodiment comprises: a magnetic sensor 53 which is a hall sensor.

Figure 14:
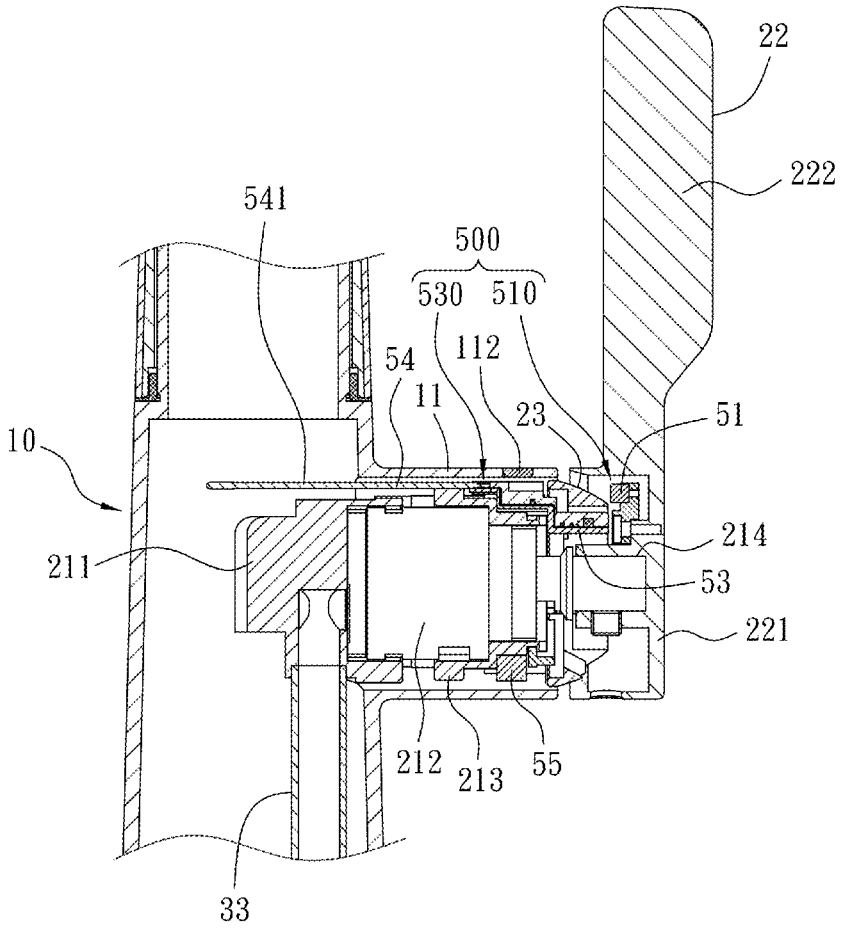
FIG. 14 is a cross sectional view showing the assembly of a part of the electronic faucet controlled by the handle according to the second embodiment of the present invention.
Figure 15:
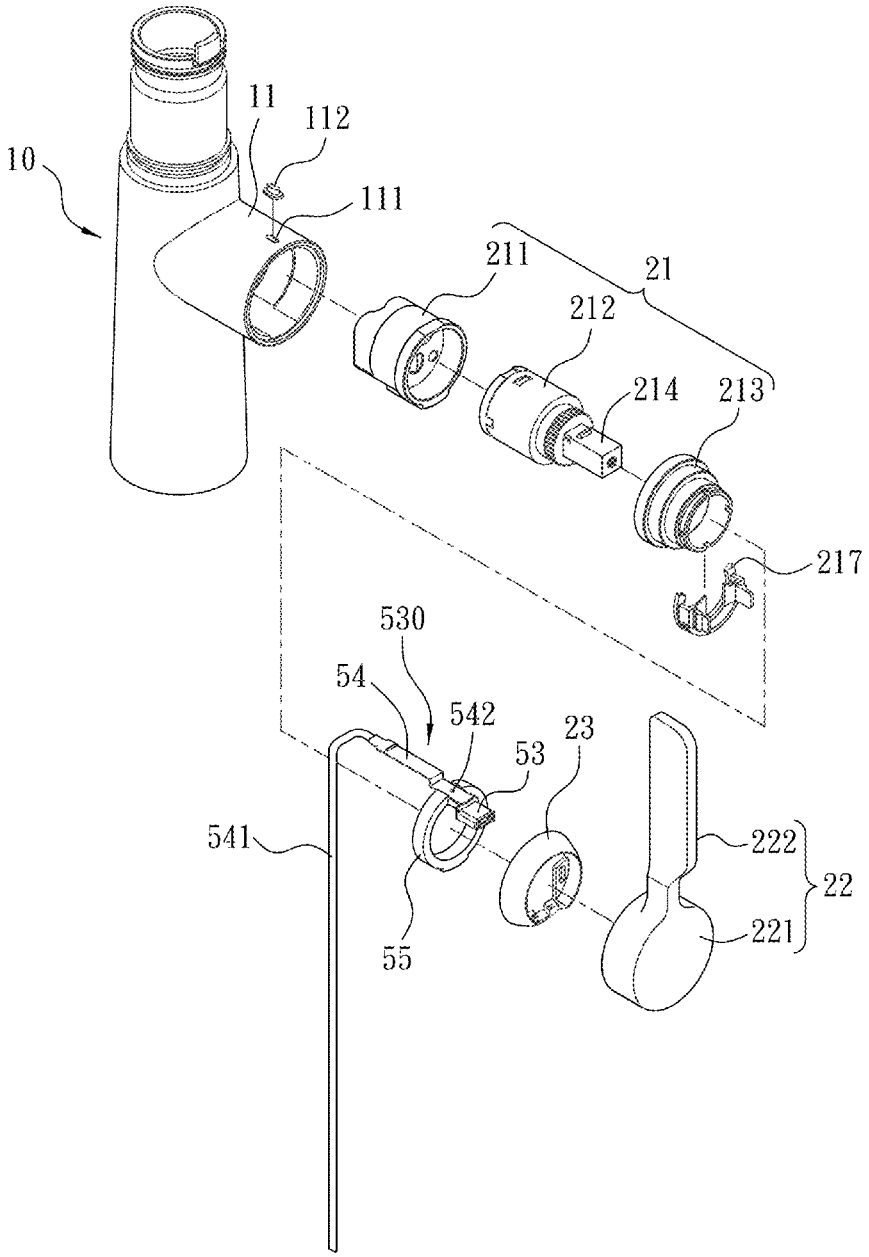
FIG. 15 is a perspective view showing the exploded components of a part of the electronic faucet controlled by the handle according to the second embodiment of the present invention.
Figure 16:
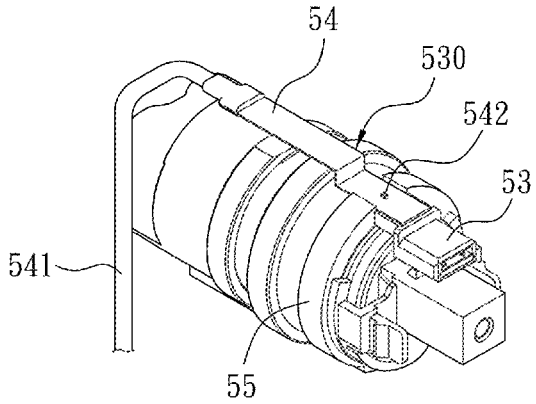
FIG. 16 is a perspective view showing the assembly of a part of the electronic faucet controlled by the handle according to the second embodiment of the present invention.
Figure 17:
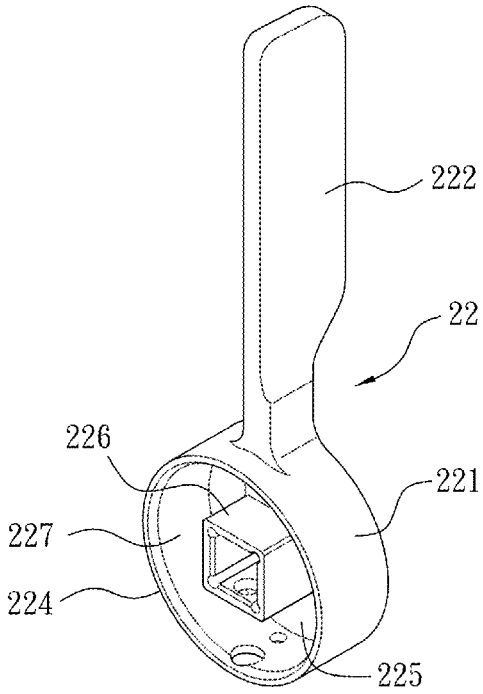
FIG. 17 is another perspective view showing the assembly of a part of the electronic faucet controlled by the handle according to the second embodiment of the present invention.
Figure 18:
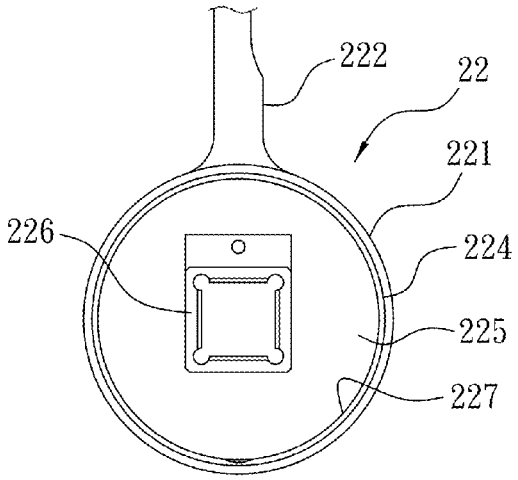
FIG. 18 is a side plan view showing the assembly of a part of the electronic faucet controlled by the handle according to the second embodiment of the present invention.
Figure 19:
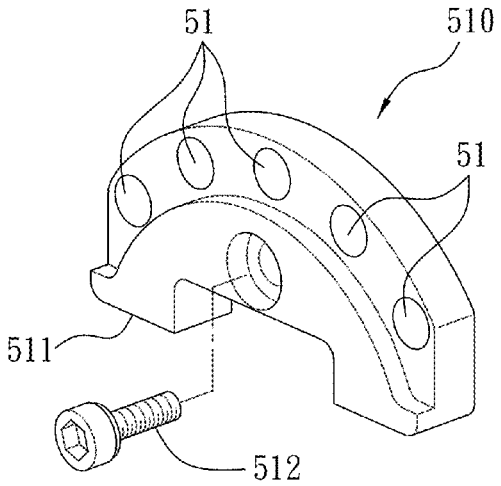
FIG. 19 is also another perspective view showing the assembly of a part of the electronic faucet controlled by the handle according to the second embodiment of the present invention.
Figure 20:
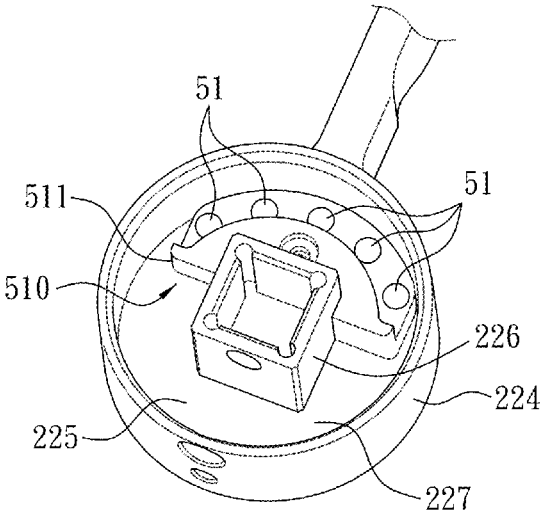
FIG. 20 is still another perspective view showing the assembly of a part of the electronic faucet controlled by the handle according to the second embodiment of the present invention.
Figure 21:
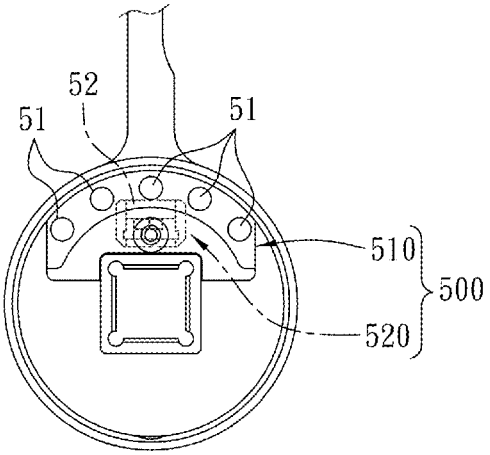
FIG. 21 is a side plan view showing the operation of the electronic faucet controlled by the handle according to the second embodiment of the present invention.

Referring further to FIGS. 14 to 16, the electronic faucet 1*a* controlled by handle of the second embodiment also comprises a magnetic sensing device 500, and the magnetic sensing device 500 includes a sensing module 530. As shown in FIG. 21, the sensing module 530 has the magnetic sensor 53, a flexible print circuit (FPC) 54 welding with the magnetic sensor 53, an affix loop 55 welding with the flexible print circuit 54, and a transmission wire 541 electrically connected with the flexible print circuit 54 to transmit a sensing signal to a controlling panel 401. The affix loop 55 is fitted on a lid 213 so that the sensing module 530 is fixed on a valve member 21. The flexible print circuit 54 is bendable and is laminated to be accommodated between the handle seat 11 and the valve member 21.

As illustrated in FIGS. 15 and 16, the flexible print circuit 54 further has a light emitting diode (LED) 542, the handle seat 11 has a notch 111 formed thereon and has a light shield 112 disposed on the notch 111. The light emitting diode (LED) 542 emits lights via the light shield 112, when the rotary lever 22 is rotated toward the opened position, hence the user distinguishes the electronic faucet 1*a* is in a water supply state. When the rotary lever 22 is rotated toward the closed position, the light emitting diode (LED) 542 stops emitting the light, hence the user distinguishes the electronic faucet 1*a* is in a water stop state.

With reference to FIG. 15, the valve member 21 further has a locking element 217 for locking with the lid 213 and for retaining with the decorative cover 23, such that the affix loop 55 is limited on the lid 213, and the decorative cover 23 is positioned on the valve member 21.

Referring to FIGS. 17 to 20, the base 221 of the rotary lever 22 has a circular fence 224 connecting with the operating extension 222, a peripheral fence 225 coupling with the circular fence 224, and a fitting pedestal 226 extending outwardly from the peripheral fence 225, wherein between the peripheral fence 225 and the fitting pedestal 226 is defined a groove 227. The magnetic sensing device 500 includes a magnetism module 510, and the magnetism module 510 has a rack 511 mounted in the groove 227 and has a plurality of magnetic elements 51 arcuately arranged on the rack 511. The rack 511 is locked on the peripheral fence 225 by ways of a screw bolt 512.

Figure 22:
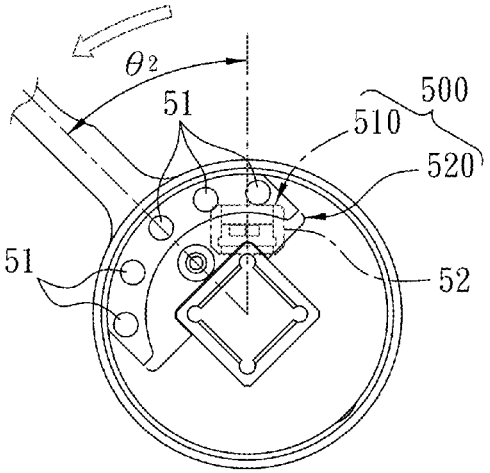
FIG. 22 is another side plan view showing the operation of the electronic faucet controlled by the handle according to the second embodiment of the present invention.
Figure 23:
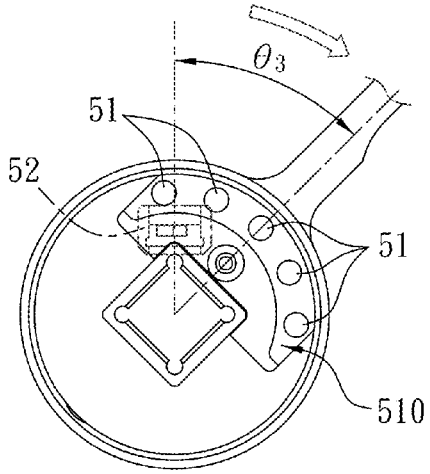
FIG. 23 is also another side plan view showing the operation of the electronic faucet controlled by the handle according to the second embodiment of the present invention.

As shown in FIGS. 21 to 23, each of the plurality of magnetic elements 51 is formed in a column shape, and the plurality of the magnetic elements 51 are arcuately arranged on the rack 511. Accordingly, the rotary lever 22 is rotated toward any one of a cold-water supply position, a hot-water supply position, and a mixing-water supply position. For example, the rotary lever 22 is rotated a third angle 02 counterclockwise toward one of the cold-water supply position and the hot-water supply position, as illustrated in FIG. 22. In addition, the rotary lever 22 is rotated a fourth angle θ3 clockwise toward the other of the cold-water supply position and the hot-water supply position, as illustrated in FIG. 23.

Preferably, at least one of the plurality of magnetic elements 51 corresponds to the magnetic sensor 52, hence the magnetic sensing device 500 operates well.

Thereby, the electronic faucet of the present invention controls the solenoid valve to open or close by using the magnetic sensing device, thus starting and stopping water supply of the electronic faucet.

Preferably, the magnetic sensing device is compact and is fixed easily to reduce production cost. For instance, the magnetic sensor 53 of the second embodiment is the hall sensor welded on the flexible print circuit 54, and the flexible print circuit 54 is bendable and is laminated to be accommodated easily between the handle seat 11 and the valve member 21.

The magnetic sensing device has no any contact points therein to avoid defective contact and to be operated sensitively and stably.

Furthermore, an installation position of the magnetic sensor 52 is adjusted based on using requirement.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. An electronic faucet controlled by handle comprising:

a body mounted on a washbasin and including a handle seat and an outlet;

a control assembly fixed on the handle seat of the body and including a valve member and a rotary lever rotated to control the valve member; the rotary lever being rotated toward an opened position and a closed position;

a water pipe set including a cold-water inlet pipe, a hot-water inlet pipe, and a mixing outlet pipe communicating with the valve member of the control assembly to guide cold water and hot water into the valve member and to guide mixing water, in which the cold water and the hot water are mixed, out of the outlet of the body via the valve member;

a solenoid valve secured on the mixing outlet pipe and opened to allow flowing of the mixing water, and the solenoid valve being closed to stop the mixing water;

a magnetic sensing device including a magnetic element mounted on the rotary lever; a magnetic sensor fixed between the handle seat and the valve member adjacent to the magnet element;

wherein when the rotary lever is rotated toward the opened position, the magnetic element moves away from the magnetic sensor, such that the magnetic sensor diminishes or disappears its magnetic force to open the solenoid valve, thus flowing the mixing water; when the rotary lever is rotated toward the closed position, the magnetic element moves close to the magnetic sensor, hence the magnetic sensor is sensed by the magnetic force to close the solenoid valve, thus stopping the mixing water;

wherein the magnetic sensor is a reed switch;

wherein the magnetic sensor is coupled with the valve member; the magnetic element is coupled with a base of the rotary lever; and wherein the valve member has a holder locked in the handle seat, a valve core mounted in the holder, and a lid screwing with the holder to fix the valve core in the holder; the valve core has a driving shaft; the rotary lever has a base and an operating extension extending outwardly from the base; the base is fitted with the operating shaft of the valve core, such that the rotary lever is rotated to drive the driving shaft.

2. The electronic faucet controlled by the handle as claimed in claim 1, wherein the magnetic element is a magnet.

3. The electronic faucet controlled by the handle as claimed in claim 1, wherein the holder has a fixing slot defined thereon and has a threaded orifice proximate to the fixing slot; the magnetic sensor includes a housing, a reed switch fixed in the housing, a transmission wire electrically connected with the reed switch to transmit a sensing signal, an adjusting bolt, and a spring; the housing is retained in the fixing slot of the holder, and the housing has a positioning portion extending outwardly therefrom, wherein the positioning portion has a through hole formed thereon, such that the adjusting bolt is inserted through the through hole of the positioning portion to screw with the threaded orifice of the holder; the spring is fitted on the adjusting bolt between the positioning portion and the holder to abut against the positioning portion; when the adjusting bolt is rotated tightly, it drives the housing and the reed switch to move away from the magnetic element along the fixing slot; when the adjusting bolt is rotated loosely, the housing and the reed switch are pushed by the spring to move close to the magnetic element along the fixing slot.

4. The electronic faucet controlled by the handle as claimed in claim 3 further comprising a controlling panel for receiving a sensing signal from the reed switch via the transmission wire, and then the sensing signal is processed to transmit a control signal to open or close the solenoid valve.

5. The electronic faucet controlled by the handle as claimed in claim 1, wherein the base of the rotary lever has a circular fence connecting with the operating extension, a peripheral fence coupling with the circular fence, and a fitting pedestal extending outwardly from the peripheral fence and retained with the driving shaft of the valve core; between the peripheral fence and the fitting pedestal is defined a groove; the fitting pedestal has an arcuate fringe formed around an outer wall thereof; the magnetic element is arcuate to contact with the arcuate fringe, and when the rotary lever is rotated any one of a cold-water supply position, a hot-water supply position, and a mixing-water supply position, the magnetic element corresponds to the magnetic sensor.

6. The electronic faucet controlled by the handle as claimed in claim 1, wherein the control assembly further includes a decorative cover for retaining with an outer wall of the holder of the valve member and for covering the handle seat of the body, such that the valve member is covered in the handle seat, and a part of the base of the rotary lever is accommodated in the decorative cover; and the decorative cover has a chamber so that when the rotary lever is shifted toward the closed position or the opened position, the driving shaft of the valve core and the base of the rotary lever move downwardly or upwardly.

7. The electronic faucet controlled by the handle as claimed in claim 1, wherein when the rotary lever is located at the closed position, the driving shaft is parallel to an axis X of the valve core; and when the rotary lever is rotated toward the opened position, a first angle θ forms between the driving shaft and the axis X; wherein the first angle θ is within 15 to 45 degrees.

8. The electronic faucet controlled by the handle as claimed in claim 1, wherein the mixing outlet pipe is in connection with a pull-out spray head, and when the spray head is not pulled outwardly, it is positioned on the outlet of the body.

9. The electronic faucet controlled by the handle as claimed in claim 1, wherein the magnetic sensor is a hall sensor.

10. The electronic faucet controlled by the handle as claimed in claim 1, wherein the magnetic sensing device includes a sensing module, and the sensing module has the magnetic sensor, a flexible print circuit welding with the magnetic sensor, an affix loop welding with the flexible print circuit, and a transmission wire electrically connected with the flexible print circuit to transmit a sensing signal; the affix loop is fitted on the lid so that the sensing module is fixed on the valve member; and the magnetic sensor is a hall sensor.

11. The electronic faucet controlled by the handle as claimed in claim 10, wherein the valve member further has a locking element for locking with the lid and for retaining with the decorative cover, such that the affix loop is limited on the lid, and the decorative cover is positioned on the valve member.

12. The electronic faucet controlled by the handle as claimed in claim 10, wherein the flexible print circuit further has a light emitting diode, the handle seat has a notch formed thereon and has a light shield disposed on the notch; the light emitting diode emits lights via the light shield, when the rotary lever is rotated toward the opened position; and when the rotary lever is rotated toward the closed position, the light emitting diode stops emitting the light.

13. The electronic faucet controlled by the handle as claimed in claim 10 further comprising a controlling panel for receiving a sensing signal from the hall sensor via the flexible print circuit and the transmission wire, and then the sensing signal is processed to transmit a control signal to open or close the solenoid valve.

14. The electronic faucet controlled by the handle as claimed in claim 1, wherein the base of the rotary lever has a circular fence connecting with the operating extension, a peripheral fence coupling with the circular fence, and a fitting pedestal extending outwardly from the peripheral fence, wherein between the peripheral fence and the fitting pedestal is defined a groove.

15. The electronic faucet controlled by the handle as claimed in claim 14, wherein the magnetic sensing device further includes a magnetism module; and the magnetism module has a rack mounted in the groove and has a plurality of magnetic elements arcuately arranged on the rack; the rack is locked on the peripheral fence by ways of a screw bolt; each of the plurality of magnetic elements is formed in a column shape, and when the rotary lever is rotated toward any one of a cold-water supply position, a hot-water supply position and a mixing-water supply position, at least one of the plurality of magnetic elements corresponds to the magnetic sensor.

16. The electronic faucet controlled by the handle as claimed in claim 1 further comprising a controlling panel for receiving a sensing signal from the magnetic sensing device, and then the sensing signal is processed to transmit a control signal to open or close the solenoid valve.

17. The electronic faucet controlled by the handle as claimed in claim 16 further comprising an accommodation case for accommodating the controlling panel and the solenoid valve.

* * * * *